United States Patent [19]

Hirsch et al.

[11] Patent Number: 4,680,815

[45] Date of Patent: Jul. 21, 1987

[54] SOLAR POWERED HEADWEAR FAN

[75] Inventors: Gerald B. Hirsch; Stanley Volk; William Cirrito; Dale Brann, all of Tucson, Ariz.

[73] Assignee: Solarcraft, Inc., Tucson, Ariz.

[21] Appl. No.: 825,897

[22] Filed: Feb. 4, 1986

[51] Int. Cl.[4] ..... A61F 9/06

[52] U.S. Cl. ..... 2/171.3; 2/199

[58] Field of Search ..... 2/171.3, 199, 422, 436, 2/437, 8, 10, 6

[56] References Cited

U.S. PATENT DOCUMENTS

| | | | |
|---|---|---|---|
| 21,485 | 9/1858 | Carey | 2/199 X |
| 3,168,748 | 2/1965 | Limberg | 2/171.3 |
| 3,353,191 | 11/1967 | Dahly | 2/171.3 |
| 3,391,407 | 7/1968 | Waters | 2/171.3 |
| 3,548,415 | 12/1970 | Waters | 2/171.3 |
| 3,735,423 | 5/1973 | Droz | 2/171.3 |
| 3,813,696 | 6/1974 | Yeager | 2/171.3 |
| 3,881,198 | 5/1975 | Waters | 2/171.3 |
| 4,101,981 | 7/1978 | Boden | 2/171.3 X |
| 4,141,083 | 2/1979 | Waters | 2/171.3 |
| 4,309,774 | 1/1982 | Guzowski | 2/171.3 X |
| 4,498,202 | 2/1985 | Yamamoto | 2/171.3 X |
| 4,546,496 | 10/1985 | Lewis | 2/171.3 |

FOREIGN PATENT DOCUMENTS 1528476 10/1978 United Kingdom .

*Primary Examiner*—Peter Nerbun

*Attorney, Agent, or Firm*—Fleit, Jacobson, Cohn & Price

[57] ABSTRACT

The present invention includes a self-contained personal cooling device. It is a one-piece modular component which is pre-wired and interchangeable between different hats. The components of the modular unit are employed in the unit to effect total body cooling by evaporation and forced convection. The unit is powered by photo-voltaic energy. The cooling effect of this modular device is maximized by incorporating air vent slots adjacent to the fan motor assembly to increase the force of air delivery.

22 Claims, 9 Drawing Figures

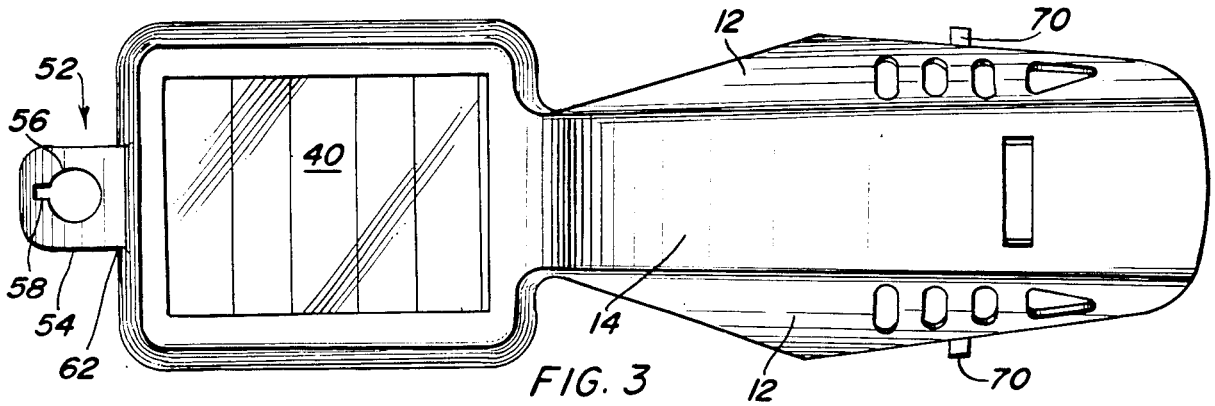
FIG. 3
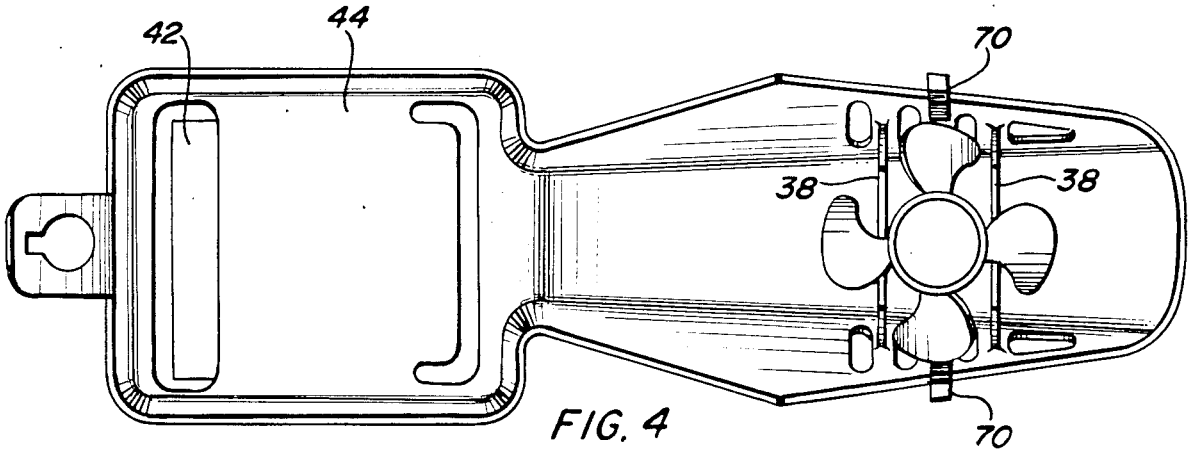
FIG. 4
FIG. 5
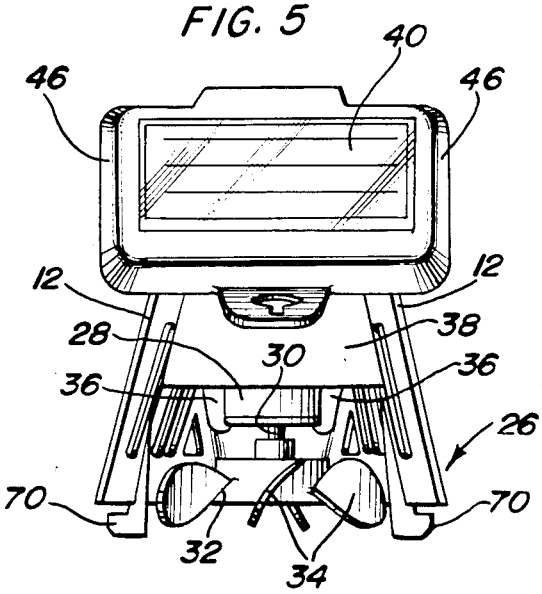
FIG. 6
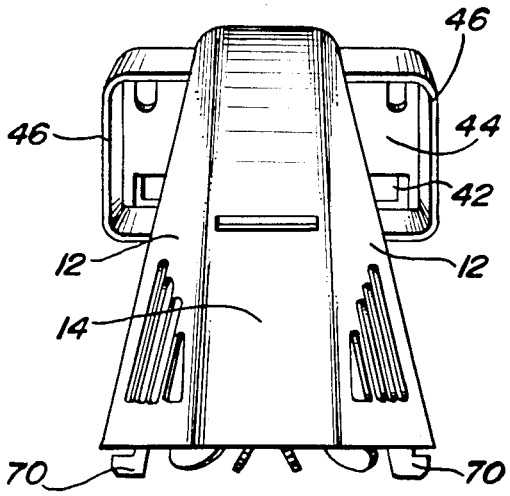

SOLAR POWERED HEADWEAR FAN

BACKGROUND OF THE INVENTION

Many sports fans have experienced the enjoyment of watching an outdoor sporting event while suffering the effects of high heat and humidity. In an attempt to overcome this problem, various hats or caps have been designed to include a fan powered by a motor. The power source for the motor of the fan has included either solar power, electric battery power or the choice of using either solar power or electric battery power. These hats include two separate components, with the power source usually being on top or inside the hat with the fan usually located in the top or the brim of the hat.

An example of such a hat is disclosed by U.S. Pat. No. 3,353,191 to Dahly, where a solar cell is disclosed which drives a motor to turn a fan to circulate air within a hat.

Other examples of headwear cooling units are disclosed by U.S. Pat. Nos. 4,141,083, 3,548,415, 3,391,407 and 3,881,198 to Waters, U.S. Pat. No. 4,546,496 to Lewis, U.S. Pat. No. 3,168,748 to Lindberg, U.S. Pat. No. 3,813,696 to Yeager, U.S. Pat. No. 3,735,423 to Droz and U.S. Pat. No. 4,101,981 to Boden.

SUMMARY OF THE PRESENT INVENTION

The present invention includes a self-contained personal cooling device. It is a one-piece modular component which is pre-wired and interchangeable between different hats. The components of the modular unit are employed in the unit to effect total body cooling by evaporation and forced convection. The unit is powered by photo-voltaic energy. The cooling effect of this modular device is maximized by incorporating air vent slots adjacent to the fan motor assembly to increase the force of air delivery.

In known cooling units, the separate components of power source and fan are either glued or screwed to a hat to permanently secure the components to the hat. The single piece modular unit of the present invention includes a solar panel electrically connected to a fan motor so that when the solar panel is heated, sufficient energy is created to power the motor and thus rapidly turn the fan which is mounted on the motor shaft.

It is a object of the present invention to provide a one-piece modular unit which includes a power source and a fan.

It is another object of the present invention to provide a one-piece modular unit which includes a solar panel and a fan, the modular unit being interchangeable between different head gear.

It is still another object of the present invention to provide a one-piece modular unit which draws air into the unit and forces the air through an opening in a hat and onto its wearer.

BRIEF DESCRIPTION OF THE DRAWINGS

FIG. 3 is a top plan view of the modular fan assembly.

FIG. 4 is a bottom plan view of the modular fan assembly.

FIG. 5 is a rear elevational view of the modular fan assembly.

FIG. 6 is a front elevational view of the modular fan assembly.

DETAILED DESCRIPTION OF THE PREFERRED EMBODIMENTS

Figure 1:
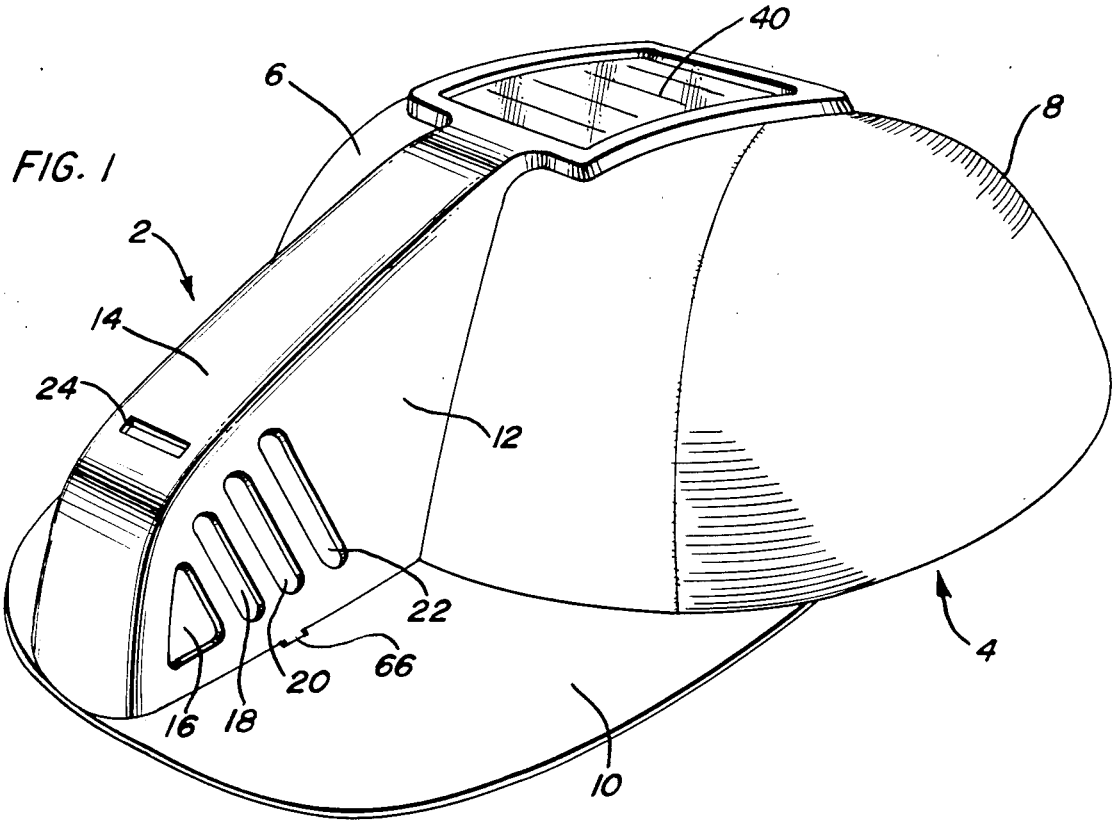
FIG. 1 is a perspective view of a modular fan assembly unit mounted onto a cap.

In describing a preferred embodiment of the invention illustrated in the drawings, specific terminology will be resorted to for the sake of clariety. However, the invention is not intended to be limited to the specific terms enumerated, and it is to be understood that each specific term includes all technical equivalents which operate in a similar manner to accomplish a similar purpose.

In FIG. 1, housing 2 of a modular fan assembly is shown removably mounted onto the exterior surface of baseball cap 4. The crown of the cap includes solid portion 6 and nylon mesh portion 8. Visor, bill or beak 10 extends as a forward protuberance, extending away from the crown portions 6 and 8. It is understood that other hats or caps such as full brim hats, hard hats, welding helmets, etc. may be used instead of the baseball cap shown.

A button (not shown) is located on the top of the crown of the cap 4. The modular fan assembly 2 is removably secured to the button by a "living" hinge (not shown) to mount the modular fan assembly on the cap 4. The fan assembly is referred to as being "modular" because it is removable from a cap upon which it is mounted and transferrable to other headgear or for other uses.

Figure 2:
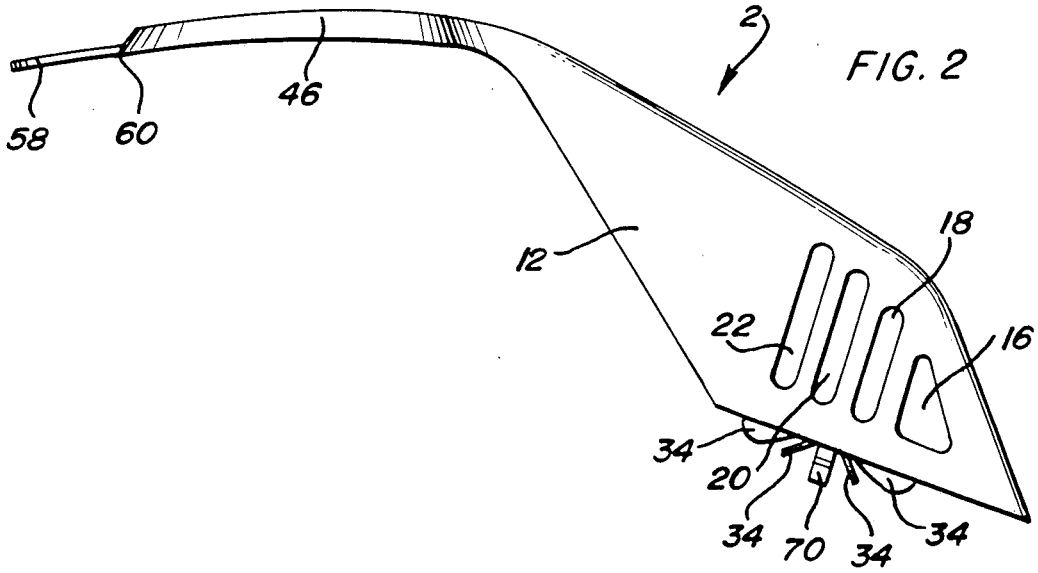
FIG. 2 is a side elevational view of the modular fan assembly.

As shown in FIGS. 1 and 2, housing 2 of the modular fan assembly includes side panels 12 and top panel 14. Side panels 12 converge towards each other and provide sufficient clearance for the fan motor and fan blades which are mounted on the motor shaft. The enclosed area formed between side panels 12, top panel 14 and the exterior surfaces of the visor 10 and crown portion 6 is dimensioned to control a fan motor assembly. The fan motor assembly draws air in through vent openings 16, 18, 20, and 22 which are formed in each side panel 12 and through vent opening 24 formed in top panel 14.

Fan motor assembly 26 is shown in FIG. 5. The fan assembly includes motor 28, motor shaft 30 and propeller 32 which includes four fan blades 34. Motor 28 is held within the enclosed area defined by the side panels 12 and top panel 14 by hooks 36 which extend from side panel 12. In addition, two retaining plates 38 extend from the side panels 12 and top panel 14 to hold the sides of the motor 28 in place. The fan motor assembly occupies a minority portion of the enclosed area.

Solar panel 40 is mounted on housing 2 of the modular fan assembly. A bottom surface 42 of solar panel 40 is supported by plate 44 of the housing 2 and protected along its edges by side portions 46, from which the solar panel 40 is recessed. Solar panel 40 is mounted on the housing 2 exteriorally of the enclosed area defined by side panels 12, top panel 14 and the exterior surfaces of cap 4 and at the end of housing which is opposite to the end within which the fan assembly 26 is mounted.

The portion of side panels 12 in which the vent opening 16, 18, 20 and 22 are not formed, is used for display of decorative material. Team logos, names, slogans, and other graphics may be prominately displayed on side panels 12 without interferring with the flow of air through vent openings 16, 18, 20 and 22.

Figure 7:
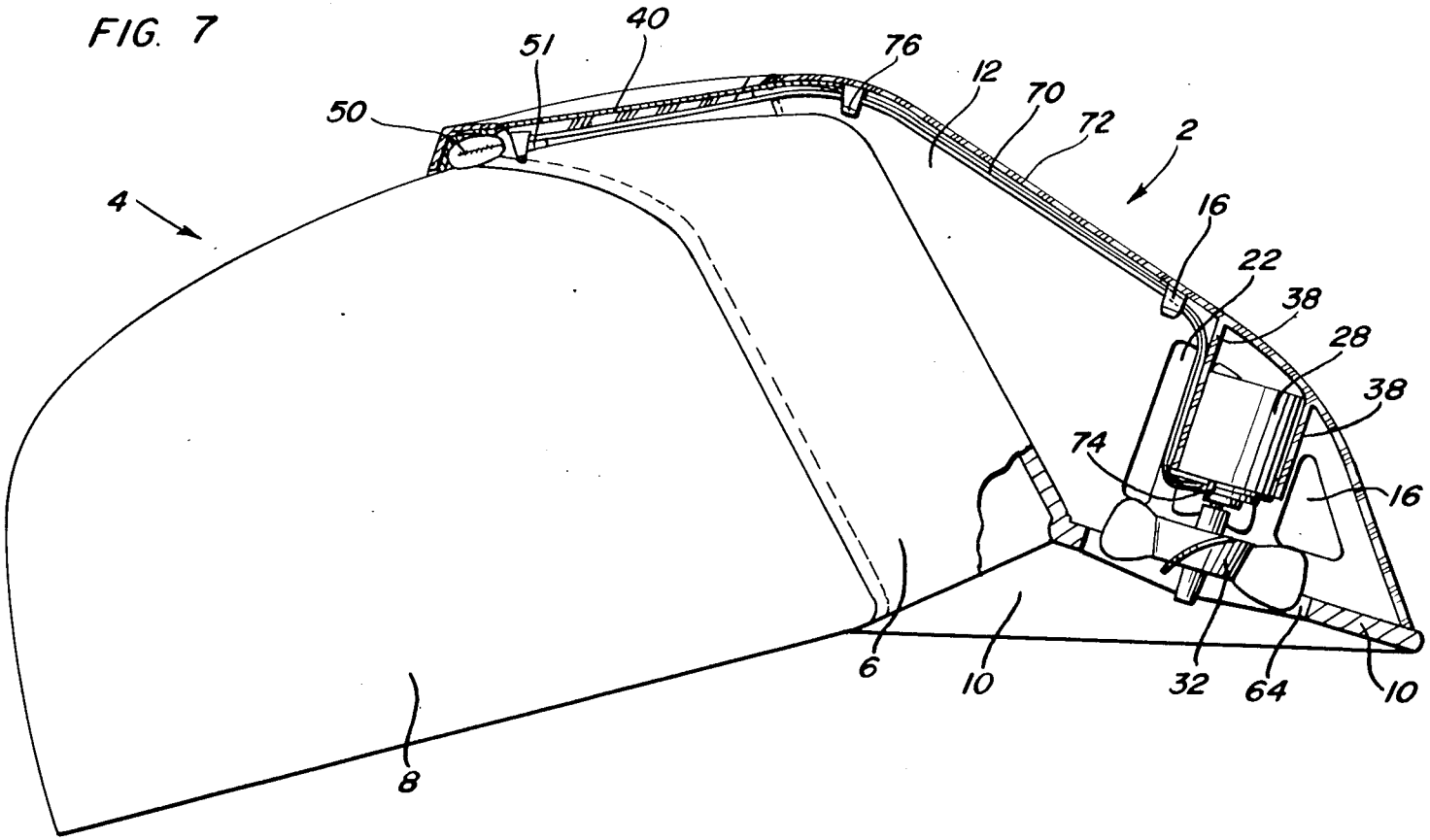
FIG. 7 is a partial cross-sectional view of the modular fan assembly mounted on a cap.
Figure 8:
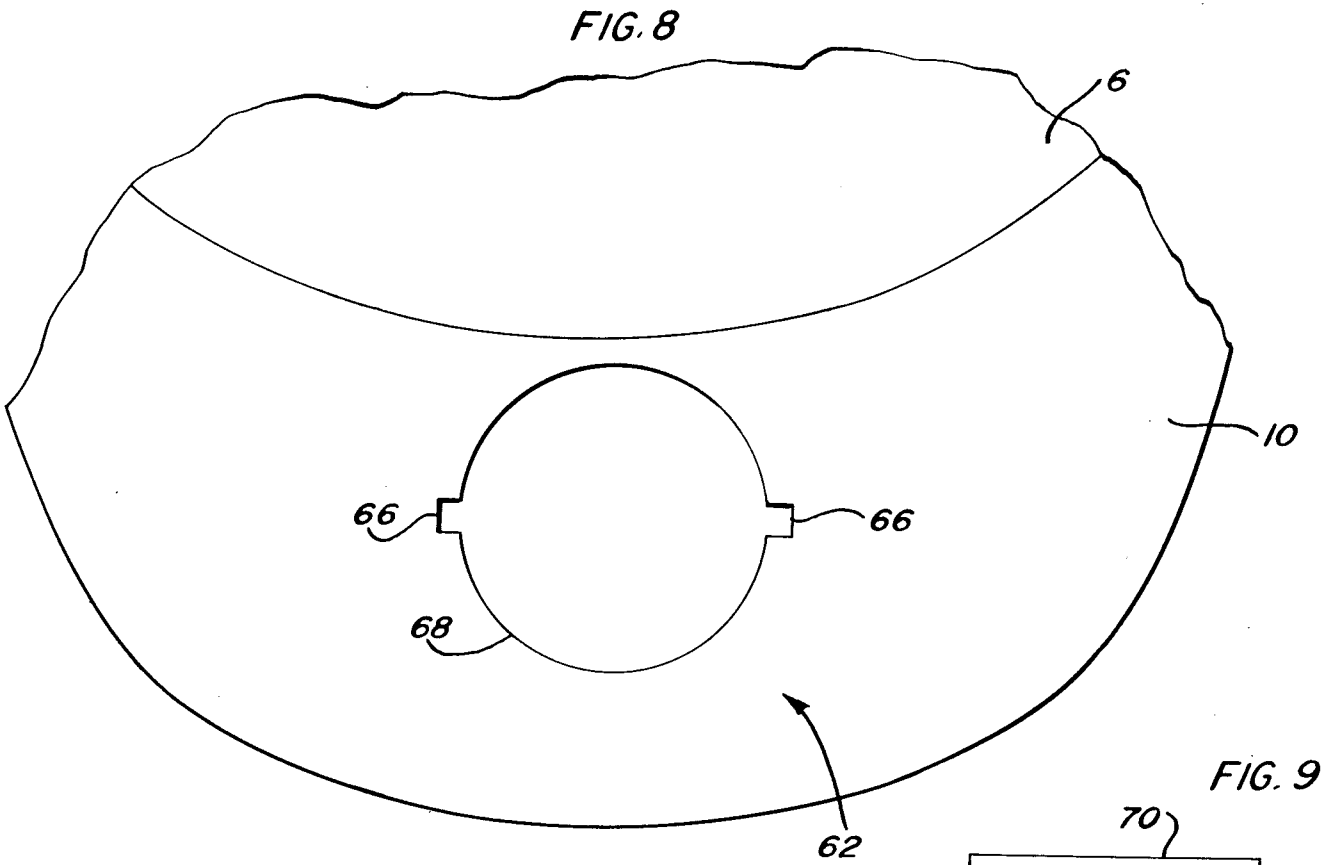
FIG. 8 is a top plan view of the visor of the cap shown in FIG. 7.

Housing 2 is mounted on the exterior of cap 4 at two different areas. At the top of the crown of cap 4, as shown in FIG. 7, is a button 50.

A "living" hinge 52 extends from the end of the housing which contains the solar panel 40. A "living" hinge is capable of being bent many times without breakage. In this case, the plastic material forming the hinge is well suited for many repeated uses without failure.

The hinge 52 includes flat planar portion 54 which includes opening 56 and slot 58. Slot 58 extends from one side of opening 56 away from solar panel 40. A narrowed thickness 60 of hinge 52 interconnects portion 54 and the housing 2. The narrowed portion 60 provides for the bending of the hinge 52 towards the bottom surface 42 of solar panel 40.

The opening 56 is dimensioned so that the button 50 may pass through opening 56. By placing the hinge 52 over the button 50 when the portion 54 extends in a direction continuous with the housing 2, and by movement of the housing 2 in a direction away from the visor 10, slot 58 is forced under the button 50 and around the stem, rivet or projections which secure the button 50 to the top of the crown of the hat. The housing is then pivioted around narrowed portion 60 such that the housing 2 comes to rest in the position shown in FIG. 1.

There is an opening 62 defined by the visor 10 of the cap. The opening 62 includes a circular portion 64 having two rectangular slots 66 located on opposite sides of the circular portion 64.

Side panels 12 include two downwardly projecting hooks 70, shown in FIGS. 5 and 6. The distance across the outer extremities of hook 70, below the edge of side panels 12, is slightly greater than the distance between the outer extremities of slots 66. Therefore, when the housing 2 is brought down towards the opening 62 after being secured to the button 50, the hooks 70 are forced down into and through the slots 66 so as to reliably hold the housing 2 to the visor 10. However, by sliding the housing 2 to one side towards either of slots 66, and exerting a slight pressure away from the cap, the housing 2 is released from the opening 62.

The end of the housing in which the solar panel 4 is located is also removably mounted on the button at the top of the crown of the cap as is the end of the housing secured to the visor 10. Therefore, although the housing 2 may be reliably held on the cap 4, it is easily removable for transferrence to another cap or for use independent of headwear.

The bottom edge of the side panels 12 is aligned with the exterior surface of the visor 10 and portion 6 of the crown to form an enclosed area within which the fan motor assembly 26 is mounted. The tip of the fan blades 34 protrude through the opening 62 when the housing 2 is mounted on the cap. This assures that the full force of the air being sucked in through vent openings 16, 18, 20 and 22, when the fan assembly is powered by the solar cell panel 40, is directed through opening 64.

The vent openings 16, 18, 20, 22 and 24 are dimensioned to approximate 95% of the surface area occupied by circular openings 64. This means that the ratio of the size of the vent openings to the size of circular opening 64 equals 0.95. Vent opening 24 may be eliminated by a commensurate increase in the size of the openings defined in the side panels 12. It is important that the side panel openings be maintained adjacent to the fan motor assembly to provide for a direct line of flow of air into the enclosed area which is defined by side panels 12 and top panels 14 and out through opening 62 in a direction towards the face of the wearer of the cap. The portion of side panels 12 unoccupied by vent openings is used for display of graphic materials.

Figure 9:
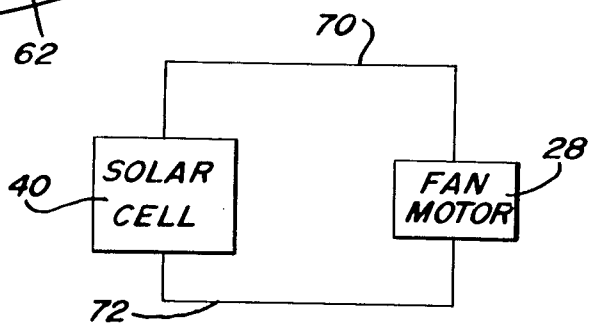
FIG. 9 is a schematic circuit diaphragm of the solar cell and fan motor.

As shown in FIG. 9, solar cell panel 40, available from Photocomm, Inc., of Escondido, Calif. provides a minimum 3.20 volts at 60 milliamps from the heat of the sun or other heat source. The fan motor 28 is connected to solar cell 40 by 32 guage wires 70 and 72 at weld contact point 74. Fan motor 28 is available from NISSI, Inc. as a series E motor having a power requirement of 3 volts at 40 milliamps. At 3 volts, 40 milliamps, motor 28 rotates propeller 32 at 3600 RPMs. As the power produced by solar cell panel 40 increases, the speed of the propeller increases proportionally. The propeller normally operates in a range of 3600 to 5200 RPMs. The fan propeller 32 is available from Thorgren Tool and Molding Company, part no. 175C059RSHC1.

The solar powered panel cell is dimensioned at approximately 30 square centimeters as a minimum size to provide sufficient power for fan motor 28 with an added in safety factor. An increase in the size of the solar cell panel will result in greater power being output to fan motor 28.

As shown in FIG. 7, wires 70 and 72 extend from solar cell panel 40 to fan motor 28 and are held in position by clips 76 which are mounted on the inside of top panel 14.

The housing 2 is a single unit plastic molded part made from nylon material, preferrably type 6 and is of any preferred color. A major portion of top panel 14 is sloped at an angle of 18 degrees with a forwardmost portion which approaches the bottom edge of the housing 2 forming an angle of 36 degrees to provide clearance for the fan motor blades.

Having described the invention, many modifications thereto will become apparent to those skilled in the art to which it pertains without deviation from the spirit of the invention as defined by the scope of the appendant claims. These and other objects of the invention, as well as many of the intended advantages thereof, will become more readily apparent when reference is made to the following description taken in conjunction with the accompanying drawings.

We claim:

1. A fan assembly comprising:

a housing adapted for resting on an exterior surface of headwear, fan means mounted in said housing at one end of said housing and adapted for forcing air through an opening defined in a forward protuberance of the headwear, solar cell means mounted on said housing at another end of said housing opposite to and remote from said one end for powering said fan means and adapted for resting on a crown of the headwear, vent means defined by said housing for allowing air to be sucked into said housing and forced out of said housing when said power means drive said fan means, mounting means defined by said housing including hinge means for removably mounting said modular fan assembly on an exterior surface of the headwear, a portion of said housing occupies a substantial distance between said fan means and said solar cell means, and display means defined by said portion of said housing between said power means and said fan means for displaying of decorative graphic material.

2. A fan assembly as claimed in claim 1, wherein said fan means includes fan blades mounted on a shaft of a motor.

3. A fan assembly as claimed in claim 1, wherein said mounting means is defined adjacent to said power means for mounting said housing on the exterior surface of the headwear.

4. A fan assembly as claimed in claim 1, wherein said mounting means also is partly located adjacent to said fan means for mounting said housing on the forward protuberance of the headwear.

5. A fan assembly as claimed in claim 1, wherein said portion of said housing includes two side panels and a top panel for enclosing said fan means, said vent means being defined by at least one of said two side panels and said top panel.

6. A fan assembly as claimed in claim 5, wherein said two side panels are converging.

7. A fan-cooled headwear assembly comprising:

head covering means including a crown and a protuberance extending away from said crown, a housing mounted on an exterior surface of said head covering means, fan means mounted in said housing at one end of said housing and above said protuberance, solar cell means mounted on said housing at another end of said housing opposite to and remote from said one end and above said crown for powering said fan means, mounting means defined by said housing including hinge means for removably mounting the housing on the head covering, transfer means for transmitting power from said power means to said fan means to drive said fan means, vent means defined by said housing for allowing air to be sucked into said housing and forced out of said housing through an opening defined in said protuberance when said power means drives said fan means, a portion of said housing occupies a substantial distance between said fan means and said solar cell means, and display means defined by said portion of said housing between said power means and said fan means for displaying graphic material.

8. A fan-cooled headwear assembly as claimed in claim 8, further comprising mounting means for removably mounting said assembly on said exterior surface of said head covering means.

9. A fan assembly as claimed in claim 8, wherein said hinge means removably engages and locks with a button located on said crown, said hinge being folded under said housing upon locking with said button to conceal said button when said housing is mounted on said head covering means.

10. A fan assembly as claimed in claim 8, wherein said mounting means includes hook means defined by said housing for engaging opposite sides of said opening.

11. A fan assembly as claimed in claim 7, wherein said housing includes two side panels and a top panel for enclosing said fan means, said vent means being defined by at least one of said two side panels and said top panel.

12. A fan assembly as claimed in claim 11, wherein said two side panels are converging.

13. A fan-cooled headwear assembly comprising:

head covering means including a crown and a protuberance extending away from said crown, a housing mounted on an exterior surface of said head covering means, fan means mounting in said housing at one end of said housing and above said protuberance, solar cell means mounted on said housing at another end of said housing opposite to and remote from said one end and above said crown for powering said fan means, mounting means defined by said housing including hinge means for removably mounting the housing on the head covering, transfer means for transmitting power from said power means to said fan means to drive said fan means, vent means defined by said housing for allowing air to be sucked into said housing and forced out of said housing through an opening defined in said protuberance when said power means drives said fan means, said housing includes a plurality of panels, said plurality of panels and said exterior surface of said head covering means defining an enclosed area, said fan means being located at said one end of said housing and at one end of said enclosed area, said solar cell means being located outside of said enclosed area and at said other end of said housing opposite to said one end, a portion of said housing occupies a substantial distance between said fan means and said solar cell means, and display means defined by said portion of said housing between said power means and said fan means for displaying of decorative graphic material.

14. A fan assembly as claimed in claim 13, wherein said hinge means removably engages and locks with a button located on said crown, said hinge being folded under said housing upon locking with said button to conceal said button when said housing is mounted on said head covering means.

15. A fan assembly as claimed in claim 13, wherein said mounting means includes hook means defined by said housing for engaging opposite sides of said opening.

16. A fan assembly as claimed in claim 3, wherein said hinge means removably engages and locks with a button located on the crown, said hinge being folded under said housing upon locking with the button to conceal the button when said housing is mounted on the headwear.

17. A fan assembly as claimed in claim 16, wherein said hinge includes a keyhole shaped opening for engaging with an interconnection between the button and the crown of the headwear.

18. A fan assembly as claimed in claim 17, wherein a slot of said keyhole shaped opening engages said interconnection between the button and the crown of the headgear.

19. A fan assembly as claimed in claim 9, wherein said hinge includes a keyhole shaped opening for engaging with an interconnection between said button and said crown of said head covering means.

20. A fan assembly as claimed in claim 19, wherein a slot of said keyhole shaped opening engages said interconnection between said button and said crown of said head covering means.

21. A fan assembly as claimed in claim 14, wherein said hinge includes a keyhole shaped opening for engaging with an interconnection between said button and said crown of said head covering means.

22. A fan assembly as claimed in claim 21, wherein a slot of said keyhole shaped opening engages said interconnectioin between said button and said crown of said head covering means.

* * * * *